US008764509B1

(12) United States Patent
Lytle

(10) Patent No.: US 8,764,509 B1
(45) Date of Patent: Jul. 1, 2014

(54) YOYO WITH AN INDEPENDENTLY ROTATING MAGNETIC SIDECAP

(76) Inventor: Zachary Ross Lytle, Santa Rosa, CA (US)

( * ) Notice: Subject to any disclaimer, the term of this patent is extended or adjusted under 35 U.S.C. 154(b) by 538 days.

(21) Appl. No.: 12/388,510

(22) Filed: Feb. 18, 2009

Related U.S. Application Data

(60) Provisional application No. 61/066,014, filed on Feb. 19, 2008.

(51) Int. Cl.
*A63H 1/30* (2006.01)

(52) U.S. Cl.
USPC ..... 446/250

(58) Field of Classification Search
USPC ..... 446/250, 236, 248, 245, 247
See application file for complete search history.

(56) References Cited

U.S. PATENT DOCUMENTS 1,932,277 A * 10/1933 Kliegl ..... 40/435
6,162,109 A * 12/2000 Baier ..... 446/250
6,196,891 B1 * 3/2001 Jamison ..... 446/250
6,565,408 B1 * 5/2003 Marcantonio et al. ..... 446/250
2008/0171488 A1 * 7/2008 Van Dan Elzen ..... 446/250

FOREIGN PATENT DOCUMENTS

WO WO 2004004859 A1 * 1/2004

* cited by examiner

*Primary Examiner* — Gene Kim
*Assistant Examiner* — Amir Klayman
(74) *Attorney, Agent, or Firm* — Michael D. Eisenberg

(57) ABSTRACT

A yoyo comprises: a first yoyo side, which includes a first yoyo half, and a first sidecap, coupled to the first yoyo half; a second yoyo side, which includes a second you half and a weighting element, coupled to the second yoyo half, for balancing the first and second yoyo sides with respect to the center of the yoyo; and an axle, for connecting the first yoyo half the second yoyo half, and configured for being attached to a string. The first and second yoyo halves rotate together, and the first sidecap rotates about the yoyo's main axis independently of the first yoyo half. The weighting element may be a magnet that enables a user to perform tricks with the yoyo. Other variants are described.

7 Claims, 7 Drawing Sheets

YOYO WITH AN INDEPENDENTLY ROTATING MAGNETIC SIDECAP

CROSS-REFERENCES TO RELATED APPLICATIONS

This application claims priority from U.S. Application Ser. No. U.S. 61/066,014 filed Feb. 19, 2008, which is hereby incorporated herein by reference in its entirety.

TECHNICAL FIELD

The present invention, in some embodiments thereof, relates to yoyos.

BACKGROUND OF THE INVENTION

The yoyo is a device consisting of two yoyo halves, an axle for connecting the two halves, and a string tied to the axle.

Before a user begins operating a yoyo, the string is round around the axle. The user holds one end on the string and throws the yoyo downwards. When the string of the yoyo is stretched, the yoyo can be made to "sleep," the axle of the yoyo spinning within a loop of string. As the body of the yoyo spins, a gyroscopic effect occurs, stabilizing the yoyo on the yoyo's axis and permitting time to perform a number of movements. By flicking the wrist, the user may make the yoyo return to the user's hand, with the string again wound around the axle. The user may engage in numerous different tricks with the yoyo in the sleep mode. The present invention enables the yoyo to perform a greater variety to tricks not seen before.

BRIEF SUMMARY OF EMBODIMENTS OF THE INVENTION

The present invention relates to a yoyo having a sidecap, which rotates independently of the rotation of the yoyo's main body.

An aspect of some embodiments of the present invention relates to a yoyo, which includes a first yoyo side, a second yoyo side, and an axle for connecting the two sides designed for being attached to a string. The first yoyo side includes a first yoyo half, and a first sidecap, coupled to the first yoyo half. The second yoyo side, includes a second you half, and a weighting element, coupled to the second yoyo half, for balancing the first and second yoyo sides with respect to the center of the yoyo. The first and second yoyo halves rotate together, and the first sidecap rotates about the yoyo's main axis independently of the first yoyo half.

According to some embodiments of the present invention, the axle is a central bearing, which includes an inner race connected to the first and the second yoyo sides, an outer race which rotates independently of the inner race, and is designed for being attached to a string.

Optionally, the weighting element is a second sidecap and rotates about the yoyo's main axis independently of the second yoyo half.

In a variant, the first sidecap is configured for being connected to an attachment, so that the attachment rotates about the yoyo's main axis with the sidecap, independently of the first yoyo half.

In another variant, the attachment is removable.

In yet another variant, the attachment is a magnet.

Optionally, the magnet is designed for joining the yoyo to a metallic surface, while the first yoyo half rotates.

According to some embodiments of the present invention, the first sidecap and the second sidecap rotate about the yoyo's main axis independently of each other.

In a variant, the above yoyo further includes a first side bearing, having an inner race connected to the first yoyo half and an outer race connected to the first sidecap; and a second side bearing, having an inner race connected to the second yoyo half and an outer race connected to the second sidecap.

In another variant, the above yoyo further includes a long bolt, having a long cylindrical threaded shaft, and a bolt head of the long bolt. The long bolt is designed for traversing an orifice of the first sidecap, without touching the first sidecap. The long bolt is further designed for traversing an orifice of the first side bearing, so that the bolt head of the long bolt pushes the first side bearing against a surface of the first yoyo half, and the long shaft does not touch the first side bearing. The long shaft is designed for being screwed into a threaded orifice of the first yoyo half, for traversing an orifice of the central bearing, without touching the central bearing, and for being screwed into a threaded orifice of the first yoyo half. Therefore, the long screw connects the first sidecap to the first yoyo half, and the first yoyo half to the second yoyo half.

In a further variant, the above yoyo further includes a short bolt, having a short cylindrical threaded shaft, and a bolt head of the short bolt. The short bolt is designed for traversing an orifice of the second sidecap, without touching the second sidecap. The short bolt is further designed for traversing an orifice of the second side bearing, so that the bolt head of the short bolt pushes the second side bearing against a surface of the first yoyo half, and the short shaft does not touch the first side bearing. The short shaft is designed for being screwed into a threaded orifice of the first yoyo half. The short bolt, therefore connects the second sidecap to the second yoyo half.

Optionally, the central bearing, the first side bearing, and the second side bearing are ball bearings.

According to some embodiments of the present invention, the first sidecap and the second sidecap rotate together about the yoyo's main axis.

In a variant, the above yoyo, further includes a bushing having an outer race connected to the first and second yoyo halves, and an inner race rotating independently of the outer race of the bushing, and a rod traversing the bushing, in contact with the inner race of the bushing, and connected to the first and second sidecaps. The first and second sidecaps rotate together about the yoyo's main axis, independently of the rotation of the first and second yoyo halves.

Optionally, the central bearing and the bushing are ball bearings.

Another aspect of the some embodiments of the present invention relates to a magnetic yoyo which includes a first yoyo half, a second yoyo half, and a first magnet connected to the first yoyo half. The first yoyo half and second yoyo half rotate together, and the first magnet rotates independently of the first yoyo half.

Optionally, the above yoyo is designed for being attached to a surface through the first magnet, such that the first and second yoyo halves rotate, while the yoyo is attached to the surface.

In a variant, the above yoyo, further includes a bearing for connecting the first yoyo half and the second yoyo half. An inner race of the bearing rotates with the first and second yoyo halves, an outer race of the bearing rotates independently of the inner race of the bearing, and the outer race of the bearing is configured for being connected to a string held by a user.

In a further variant, the above yoyo further includes a second magnet, connected to the second yoyo half and rotating independently of the second yoyo half.

Optionally, the first magnet and second magnet rotate independently of each other.

According to some embodiments of the present invention, the first magnet rotates with the second magnet.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

Figure 1:
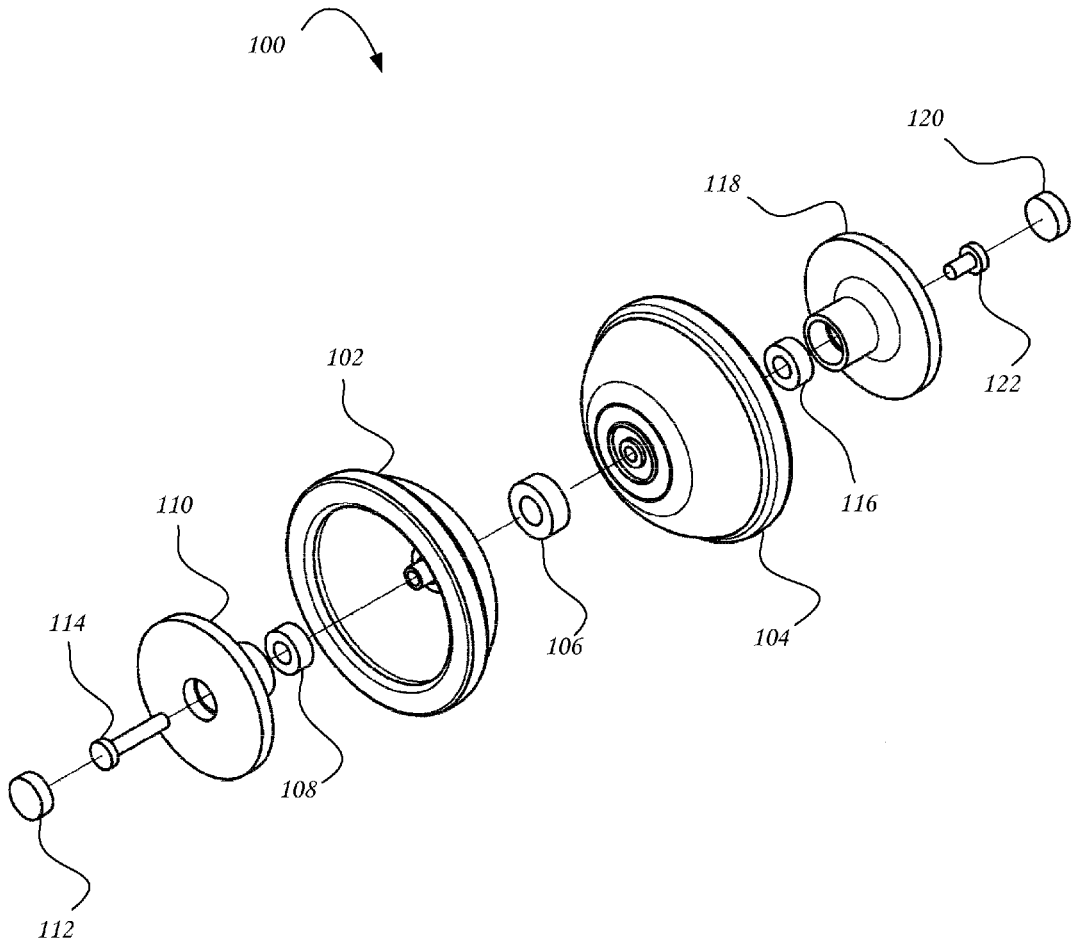
FIG. 1 is a detailed drawing illustrating a yoyo, which includes two sidecaps rotating independently of the yoyo halves and of each other, according to some embodiments of the present invention.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

Before describing embodiments of the present invention, some terms are to be defined. A yoyo is composed of two yoyo sides connected by an axle. The main axis of the axle is herein defined to be the main axis of the yoyo. The rotation of the yoyo halves, and any other elements of the yoyo takes place about the main axis of the yoyo. The term "inner surface" refers to a surface that faces the center of the axle. The term "outer surface" refers to a surface that faces away from the center of the axle.

A bearing is an axle having an inner race, facing the axle's central axis, and an outer race, facing away from the axle's central axis. The inner race and outer race rotate independently of each other about the bearings central axis. The bearing is optionally a rolling element bearing (like a ball bearing), a fluid bearing, or a magnetic bearing.

The present invention, in some embodiments thereof, relates to yoyos.

An aspect of some embodiments of the present invention relates to a yoyo, which includes at least one sidecap coupled to a first yoyo half. The sidecap rotates independently of the rotation of the first yoyo half about the yoyo's main axis. In a variant, the sidecap does not rotate during the rotation of the first yoyo half. In another variant, the sidecap is designed to be connected to an attachment, which rotates with the sidecap. Optionally, the attachment is designed to be removable, and is swappable with other attachments.

According to some embodiments of the present invention, the attachment may include an outer surface sporting an image, such as a logo or a drawing. A user may remove one attachment and insert a different attachment into the sidecap, thereby changing the appearance of the yoyo, according to the user's desire. Furthermore, because the sidecap and the attachment are still or rotate slowly while the yoyo halves rotate, the image is distinguishable while the yoyo halves rotate. Such a yoyo may be useful for advertising, as the attachment may include a logo of a sponsor. Since the logo does not rotate with the yoyo halves, the logo may be easily distinguished by an observer, while the yoyo halves are rotating.

In some variants, the attachment is a magnet. Optionally the magnet is a permanent magnet, and is used to attach the yoyo to an object made of ferromagnetic material, such as a refrigerator door, or to a second yoyo sporting a magnet or a ferromagnetic material. Because the magnet rotates independently of the yoyo halves, the yoyo halves may spin while the yoyo magnet is attached to a still object. Such a yoyo may be used for performing novel tricks, which include rotating the yoyo, while the yoyo is attached to an object.

Referring now to the figures, FIG. 1 is a detailed drawing illustrating a yoyo, which includes two sidecaps rotating independently of the yoyo halves and of each other, according to some embodiments of the present invention.

The yoyo 100 includes a first yoyo half 102, and a second yoyo half 104. An axle connects the yoyo halves 102 and 104. Optionally, the axle is hollow. According to some embodiments of the present invention, the axle is a central bearing 106, having an inner race and an outer race which rotate independently of each other. The inner race of the central bearing 106 is connected to the yoyo halves 102 and 104, so that the yoyo halves 102 and 104 rotate with the inner race of the central bearing 106. The outer race of the central bearing 106 is not in contact with the yoyo halves 102 and 104, and rotates independently of the rotation of the yoyo halves 102 and 104. The outer race of the bearing 106 is designed for being connected to a string.

The outer surface of the first yoyo half 102 is connected to the inner race of a side bearing 108. The outer race of the side bearing 108 is connected to a first sidecap 110. Because the inner race and outer race of the side bearing 108 rotate from independently of each other, the sidecap 110 rotates independently of the first yoyo half 102.

Optionally, the sidecap 110 is designed to for being connected to an attachment, which rotates with the sidecap 110. As mentioned above, the attachment may include a surface sporting an image, or a magnet. In FIG. 1, a magnet 112 is connected to the sidecap 110. Optionally, the magnet 112 is removable, and may be swapped with a different attachment.

According to some embodiments of the present invention, the second yoyo half 104 is connected to a weighting element, for balancing the sides of the yoyo 100 about the center of the yoyo. In other embodiments of the present invention, the second yoyo half 104 is connected to a second side bearing 116, a second sidecap 118, and a second magnet 122, which are connected to each other as described above.

It should be noted that in the yoyo 100, the inner races of the side bearings 108 and 116 rotate together and with the yoyo halves 102 and 104. However, the outer race of the side bearing 108 is not in contact with the outer race of the second side bearing 116, and therefore rotates independently of the outer race of the second side bearing 116. Therefore the sidecaps 110 and 118 rotate independently of each other. Thus the yoyo 100 is characterized by four degree of rotational freedom: the rotation of the outer race of the central bearing 106, to which a string is attached; the rotation of the inner race of the central bearing 106, which corresponds to the rotation of the yoyo halves 102 and 104; the rotation of the outer race of the side bearing 108, which corresponds to the rotation of the first sidecap 110; and the rotation of the outer race of the side bearing 116, which corresponds to the rotation of the second sidecap 118.

Optionally, the central bearing 106 and side bearings 108 and 116 are rolling element bearings (such as ball bearings). Alternatively, the bearings 106, 108, and 116 are fluid bearings. According to some embodiments of the present invention, the characteristics of the bearings are chosen so that the inner races of the bearings 106, 108, and 116 do not rotate, while the outer races of the bearings 106, 108, and 116 are rotating. In an exemplary embodiment of the present invention, bearings 106, 108, and 116 are ball bearings.

Optionally, the inner race of the central bearing 106 is connected to the yoyo halves 102 and 104 by sliding the inner race of the central bearing 106 to protruding elements on the inner surfaces of the yoyo halves 102 and 104, then screwing in screw 114 as described below. In such a configuration, the long screw 114 is the element which keeps the yoyo halves 102 and 104 together. Alternatively, the inner race of the central bearing 106 is pressed fit, or locked in place through a locking mechanism, onto the protruding elements on the inner surfaces of the yoyo halves 102 and 104.

Optionally, the inner race of the side bearing 108 is connected to the first yoyo half 102 by screwing the inner race of the side bearing 108 to a protruding element on the outer surface of the first yoyo half 102 as described below, in the description of FIG. 2*a*-2*d*. Alternatively, the inner race of the side bearing 108 is pressed fit, or locked in place through a locking mechanism, onto the protruding element on the outer surface of the first yoyo half 102.

Optionally, the outer race of the side bearing 108 is connected to the sidecap 110, by one of screwing, pressing fit, or locking into place the sidecap 110 onto the outer race of the side bearing 108.

According to some embodiments of the present invention, the connection between the different elements of the yoyo is performed by using bolts. Bolts are characterized by a shaft, optionally threaded, and bolt head. A long bolt 114 is used for keeping the side bearing 108 attached to the first yoyo half. It must be noted that the long bolt 114 does not touch the sidecap 110. Rather, the long bolt 114 traverses the sidecap, so that the head of the long bolt 114 comes into contact with the outer surface of the side bearing 108, and pushes the side bearing 108 against the first yoyo half 102. The shaft of the long bolt 114 (herein also referred to as "long shaft") screws into the first yoyo half 102, traverses the central bearing 106, without touching the central bearing 106, and screws into the second yoyo half 104. As the long bolt 114 is tightly screwed into the first yoyo half 102 and the second yoyo half 104, the central bearing 106 is secured between the two yoyo halves 102 and 104. Therefore, the long bolt 114 holds the yoyo 100 together, without affecting the rotation of the first sidecap 110.

Similarly, a short bolt 122 pushes the second side bearing 116 against the second yoyo half 104, and the shaft of the short bolt 122 (herein also referred to as "short shaft") screws into the second yoyo half 104. Like the long shaft, the short shaft does not touch the second sidecap 118, and therefore does not affect the rotation of the first sidecap 110.

In a variant, the magnets 112 and 120 are screwed into the sidecaps 110 and 118, respectively. In another variant, the magnets 112 and 120 are pressed fit into the sidecaps 110 and 118, respectively. In yet another variant, the magnets 112 and 120 are glued to the sidecaps 110 and 118.

According to some embodiments of the present invention, the magnets 112 and 120 are each removable from the sidecaps 110 and 118 respectively, and may be swapped with other attachments, as mentioned above.

According to some embodiments of the present invention, the magnets 112 and 120 are permanent magnets. An exemplary magnet that may be used as the magnets 112 and 120 is the magnet having product number D62, made of Nickel Plated Neodymium Grade 42N, and produced by KJ Magnetics. It must be noted that any kind of magnet may be used in yoyo 100.

Figure 2A:
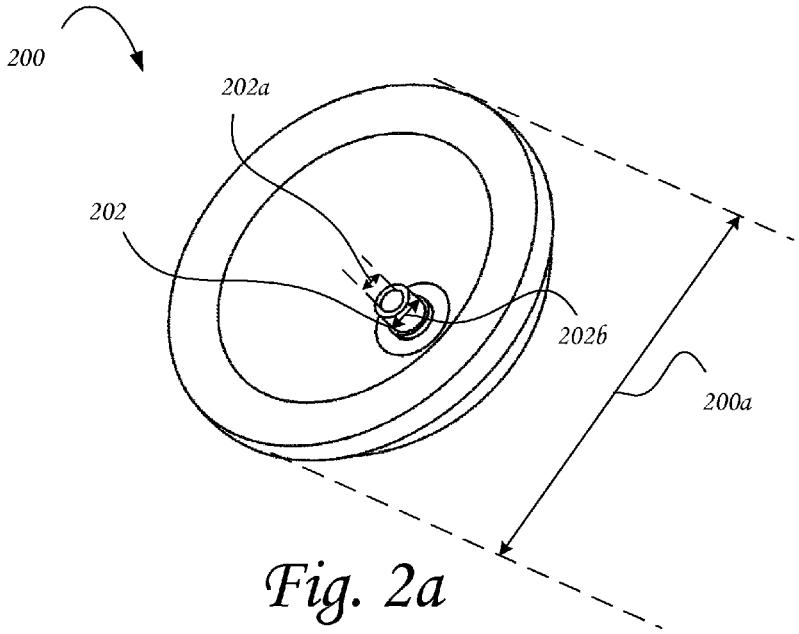
FIGS. 2*a*-2*b* are detailed drawings illustrating different views of a yoyo half, according to some embodiments of the present invention.
Figure 2B:
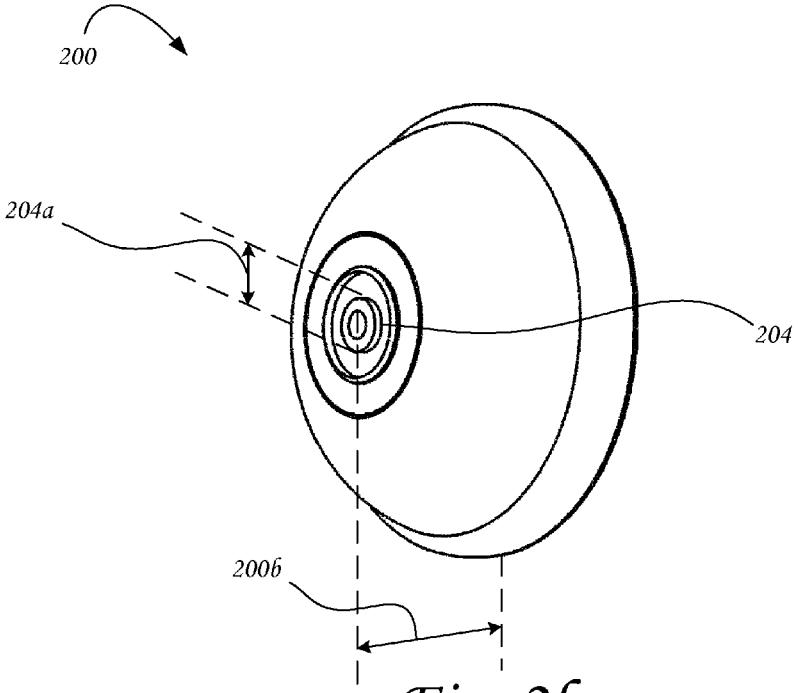

FIGS. 2*a*-2*b* are detailed drawings illustrating different views of a yoyo half, according to some embodiments of the present invention.

FIG. 2*a* is a perspective drawing showing the inner surface of the yoyo half 200. FIG. 2*b* is a perspective drawings showing the outer surface of the yoyo half 200. The yoyo half 200 may be substituted to the yoyo halves 102 and 104 if FIG. 1.

The yoyo half 200 is a concave shell having a circular cross section with diameter 200*a*, and a depth 200*b*.

The yoyo half 200 is characterized by two protrusions: an outer protrusion 202, which extends out of the outer surface of the yoyo half 200, and an inner protrusion 204, which extends out of the inner surface of the yoyo half 200.

The outer protrusion 202 is a hollow capless cylinder centered about the yoyo's main axis. The outer protrusion 202 has an inner race and an outer race. The inner race of the outer protrusion has a diameter 202*a*. The outer race of the outer protrusion has a diameter 202*b*. The outer race of the outer protrusion 200 is designed to be connected to the inner race of a side bearing (such as side bearings 108 and 116 of FIG. 1). The connection may be made in one of the manners described above. According to some embodiments of the present invention, the inner race of the outer protrusion 202 is threaded and designed for holding a threaded bolt (such as the long bolt 114 and the short bolt 122) traversing the yoyo half 200.

The inner protrusion 204 is also a hollow capless cylinder centered about the yoyo's main axis. The inner protrusion 204 is also defined by an inner race and an outer race. The inner race of the inner protrusion 204 is an extension of the inner race of the outer protrusion 202, and is traversed by the threaded bolt. The outer race of the outer protrusion 204 is designed to be connected to the inner race of a central bearing—such as the central bearing 106 of FIG. 1. The outer race of the outer protrusion 204 has a diameter 204*a*. Optionally, the outer protrusion 204 is thick walled, the thickness of the walls being chosen in order to ensure that there is no contact between the long bolt 114 and the inner race of the central bearing 106 of FIG. 1. Contact between the long bolt 114 and the inner race of the central bearing 106 may result in rotational friction between the long bolt 114 and the inner race of the central bearing 106. Such a friction may slow the rotation of the yoyo.

Figure 3A:
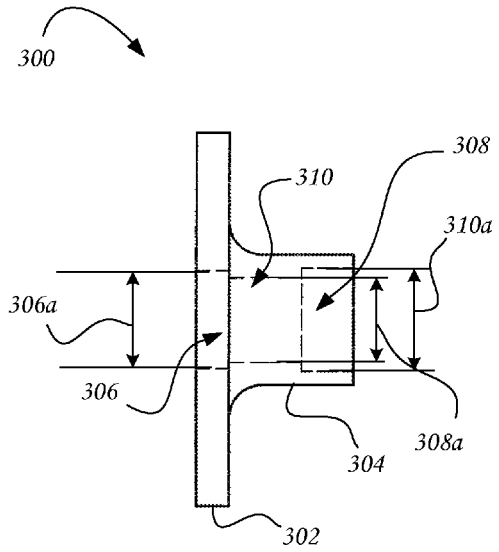
FIGS. 3*a*-3*d* are detailed drawings illustrating different views of a sidecap, according to some embodiments of the present invention.
Figure 3B:
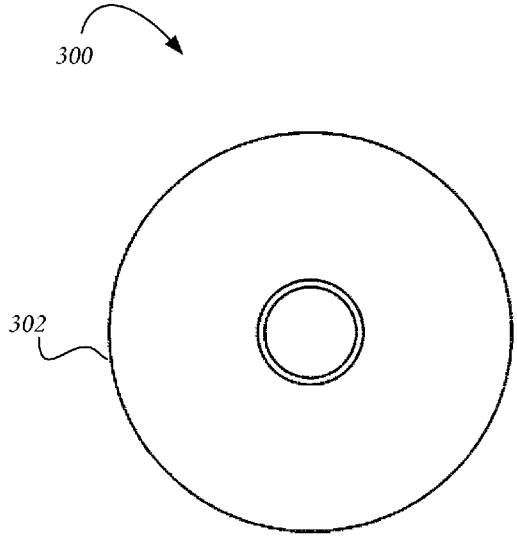
Figure 3C:
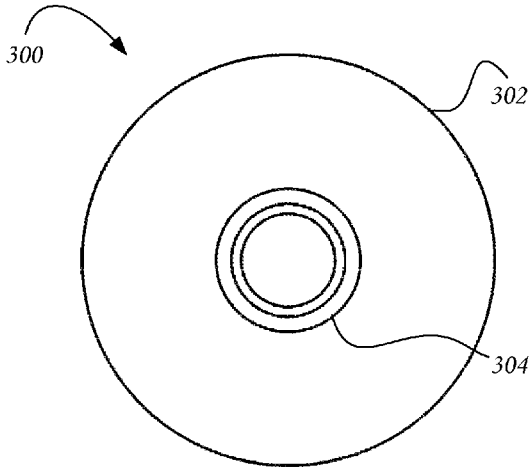
Figure 3D:
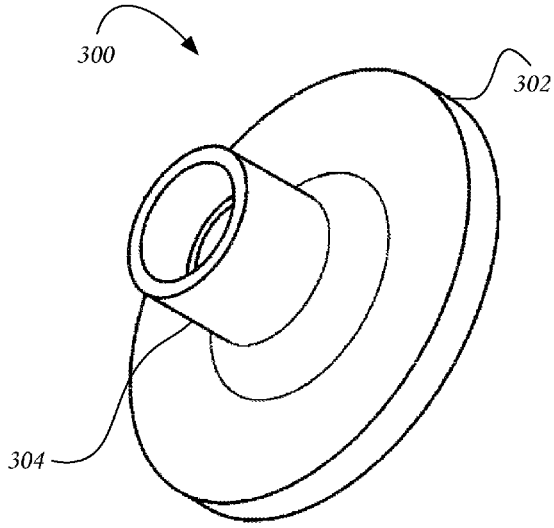

FIGS. 3*a*-3*c* are detailed drawings illustrating different views of a sidecaps, according to some embodiments of the present invention. FIG. 3*a* shows a side view of the sidecap 300. FIG. 3*b* is a front-on view of the sidecap 300 from the outer side of the yoyo. FIG. 3*c* is a front-on view of the sidecap 300 from a inner side of the yoyo. The sidecap 300 may be substituted to the first sidecap 110 and the second sidecap 118 of the yoyo 100 of FIG. 1.

The sidecap 300 is defined by an outer portion 302 facing the outside of the yoyo, and an inner portion 304 facing the inside of the yoyo. Optionally, the outer section 302 is shaped like a disk and the inner section 304 is cylindrical.

The sidecap 300 is traversed by an orifice, which has three sections: an outer section 306, closest to the outer edge of the outer section; an inner section 308, closest to the inner edge of the inner section; and a middle section 310, between the outer section 306 and the inner section 308. Optionally, the outer section 306, the inner section 308, and the middle section 310 are cylindrical. The outer section 306 has a diameter 306*a*; the inner section 308 has a diameter 308*a*; and the middle section 310 has a diameter 310*a*.

Referring back to FIG. 1, the outer section 306 of the sidecap 300 is designed for receiving and holding an attachment, such as the magnet 112. The inner section 308 is designed for receiving and holding the outer race of the first side bearing 108 or second side bearing 116. The middle section 308 is designed to be traversed by a bolt (for example the long bolt 114 or the short bolt 122). The diameter of the middle section 308 is chosen to be shorter than the diameter of the bolt head. This allows the bolt head to come into contact with the outer surface of the side bearing (108 or 116), without touching the sidecap 300. Because the bolt rotates with the yoyo halves 102 and 104, if the bolt head touches the sidecap 300, friction between the bolt head and the sidecap 300 may decrease the independence between the sidecap 300 and the yoyo halves (102 and 104). If the friction is high enough, contact between the bolt head and the sidecap 300 may cause the sidecap 300 to rotate with the yoyo halves (102 and 104).

Referring now to FIGS. 1, 2*a*-2*b*, 3*a*-3*c*, in an exemplary embodiment of the present invention, the yoyo 100 is characterized by the following elements.

A central bearing 106 having a length along the main bearing's axis of about 3/16 of an inch, a diameter of the inner race measuring about ¼ of an inch, and a diameter of the outer race measuring about ½ of an inch.

Two yoyo halves (102 and 104) modeled after the yoyo half 200, having a diameter 200*a* of about 2¼ inches, a depth 200*b* of about ⅝ of an inch, a diameter 202*a* of the inner race of the outer protrusion 202 measuring about ⅛" of an inch, a diameter 202*b* of the outer race of the outer protrusion 202*b* measuring about 5 millimeters, and a diameter 204*a* of the outer race of the inner protrusion 204 measuring about ¼" of an inch.

Two sidecaps (110 and 118) modeled after the sidecap 300, having a diameter 306*a* of the outer section 306 of the orifice measuring about 10 millimeters, a diameter 308*a* of the inner section 308 of the orifice measuring about 10 millimeters, and a diameter 310*a* of the middle section 310 of the orifice measuring about 8 millimeters.

Two cylindrical magnets 112 and 120 having diameters of about ⅜ of an inch, and thicknesses of about ⅛ of an inch.

A threaded long bolt 114 having a length of about 14 millimeters from edge to edge, and a diameter of about 4 millimeters. The long bolt 114 has a bolt head characterized by a thickness of about 3 millimeters, and a diameter to about 7 millimeters.

A threaded short bolt 122 having a length of about 4 millimeters from edge to edge, and a diameter of about 4 millimeters. The short bolt 122 has a bolt head characterized by a thickness of about 3 millimeters, and a diameter to about 7 millimeters.

Two side bearings 108 and 116 having a length along the yoyo's main axis of about 4 millimeters, a diameter of the inner race measuring about 5 millimeters, and a diameter of the outer race measuring about 10 millimeters.

Figure 4:
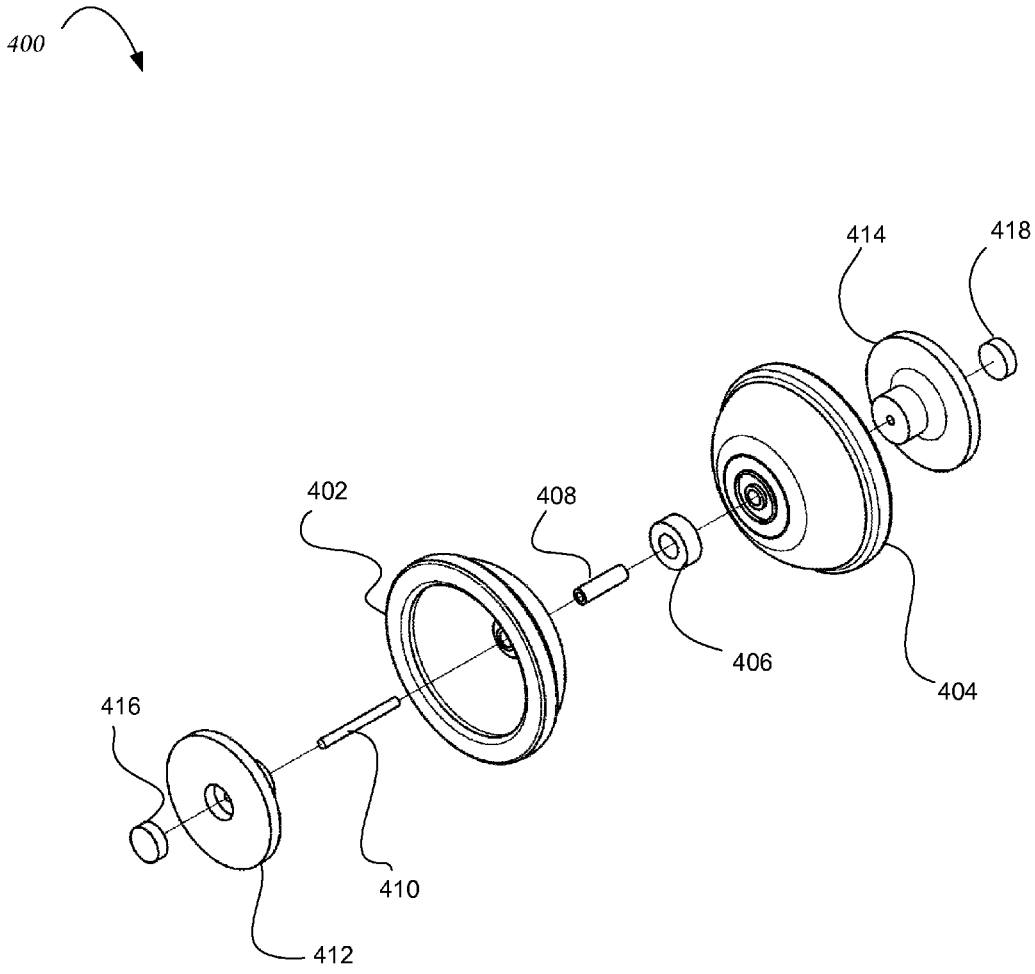
FIG. 4 is a detailed drawing illustrating a yoyo, which includes two sidecaps rotating together independently of the yoyo halves, according to some embodiments of the present invention.

FIG. 4 is a detailed drawing illustrating a yoyo 400, which includes two sidecaps rotating together independently of the yoyo halves, according to some embodiments of the present invention.

The yoyo 400 comprises a first yoyo half 402 and a second yoyo half 404, connected by an axle 408. Optionally, the axle is hollow. According to some embodiments of the present invention, this is a central ball bearing 406, having an inner race and an outer race which rotate independently of each other. In a variant, the ball bearing 406 is pinched between the yoyo halves 402 and 404. The pinching is designed so that an inner race of the central bearing 406 is connected to the yoyo halves 402 and 404, and therefore rotates with the two yoyo halves 402 and 404. An outer race of the central bearing 406 does not touch the yoyo halves 402 and 404, and therefore rotates independently of the yoyo halves 402 and 404. A string is attached to the outer race of the central bearing 406, for being held by a user.

A bushing 408 is attached to first and second yoyo halves 402 and 404. The bushing 408 is centered about the main axis of the yoyo 400. The bushing 408 is a bearing characterized by an inner race and an outer race rotating independently of each other, and only the outer race of the bushing 408 is connected to the yoyo halves 402 and 404. The yoyo halves 402 and 404, therefore rotate with the outer race of the bushing 408 and the inner race of the central bearing 406.

Optionally, the outer race of the bushing 408 is threaded and screwed into threaded orifices of the yoyo halves 402 and 404. Alternatively, the outer race of the bushing 408 is pressed fit into, locked to, or glued to the orifices of the yoyo halves 402 and 404. According to some embodiments of the present invention, as the yoyo halves 402 and 404 are secured to the bushing 408, the central bearing 406 is pinched in place between the yoyo halves 402 and 404, as mentioned above.

A rod 410 traverses the bushing 408. The rod is centered around the main axis of the yoyo 400. Each end of the rod 410 is attached to a sidecap: one end is attached to a first sidecap 412 and another end is attached to a second sidecap 414. The sidecaps 412 and 414, therefore, rotate with the rod 410, which in turns rotates with the inner race of the bushing 408. Because the inner race of the bushing 408 rotates independently of the outer race of the bushing 408, the sidecaps 412 and 414 rotate together with each other, but independently of the yoyo halves 402 and 404.

In a variant, the ends of the rod 410 are threaded and screwed into threaded orifices of the sidecaps 412 and 414. Alternatively, the ends of the rod 410 may be pressed fit into orifices of the sidecaps 412 and 414, locked to the orifices of the sidecaps 412 and 414 through a locking mechanism, or glued to the sidecaps 412 and 414.

According to some embodiments of the present invention, the sidecaps 412 and 414 may be connected to attachment, as mentioned above, in the description of FIG. 1. In the embodiment shown in FIG. 4, the attachments are magnets 416 and 418, connected to the sidecaps 412 and 414, respectively. The magnets 416 and 418 have the same properties and purpose of the magnets 112 and 120 of FIG. 1, described above.

The yoyo 400 is characterized by three degrees of rotational freedom: the rotation of the outer race of the central bearing 406; the rotation of the inner race of the central bearing 406, which rotates with the outer race of the bushing 408, which rotates with the yoyo halves 402 and 404; and the rotation the inner race of the bushing 408, which rotates with of the rod 410, which rotates with the sidecaps 412 and 414.

Figure 5A:
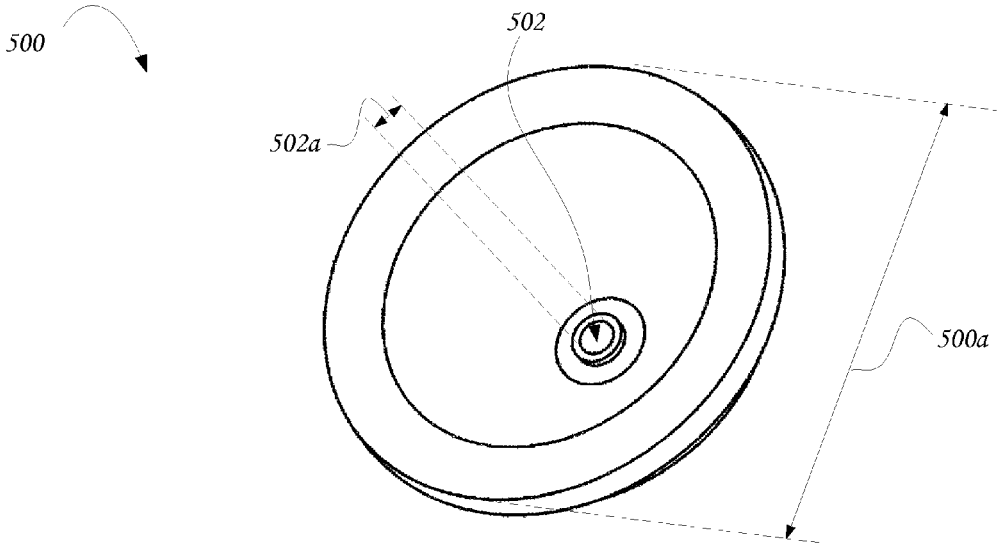
FIGS. 5*a*-5*b* are detailed drawings illustrating different views of a yoyo half, according to some embodiments of the present invention.
Figure 5B:
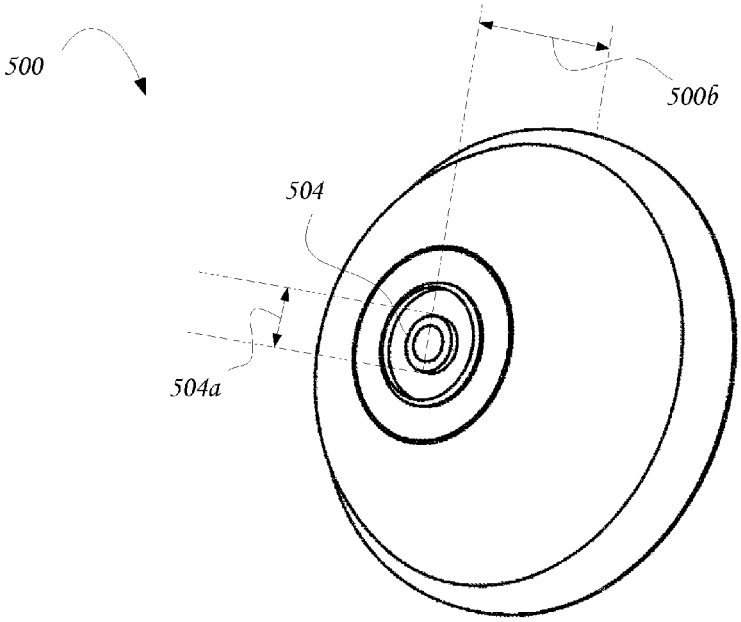

FIGS. 5*a*-5*b* are detailed drawings illustrating different views of a yoyo half, according to some embodiments of the present invention. FIG. 5*a* shows an outer surface of a yoyo half 500. FIG. 5*b* shows an inner surface of the yoyo half 500. The yoyo half 500 may be substituted to the yoyo halves 402 and 404 of FIG. 4.

The yoyo half 500 is a concave shell having a diameter 500*a* and a depth 500*b*. The yoyo half 500 sports an orifice 502, configured for being traversed by and connected to the bushing 408 of FIG. 4. The orifice 502 is optionally circular and has a diameter 502*a*. In a variant, the wall of the orifice 502 is threaded, for connecting the yoyo half 500 to the bushing 408.

On the inner surface of the yoyo half 500, a protrusion 504 is present, centered about the main axis of the yoyo. The protrusion 504 has an inner race and an outer race. The inner race of the protrusion 504 is the wall of the orifice 502, and the outer race of the protrusion 504 is optionally defined by a circular cross section with diameter 504*a*. The outer race of the protrusion 504 is designed for being connected to the inner race of the central bearing 406 of FIG. 400. In this manner, the yoyo half 500 rotates with the inner race of the central bearing.

Figure 6A:
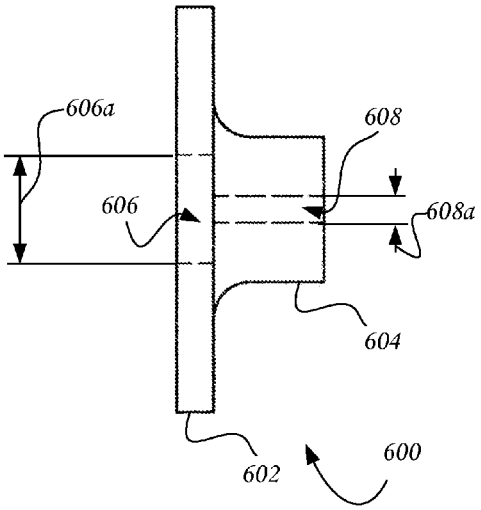
FIGS. 6*a*-6*d* are detailed drawings illustrating different views of a sidecap, according to some embodiments of the present invention.
Figure 6B:
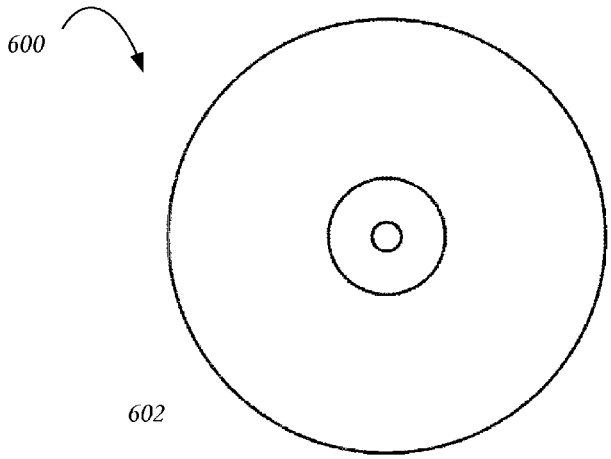
Figure 6C:
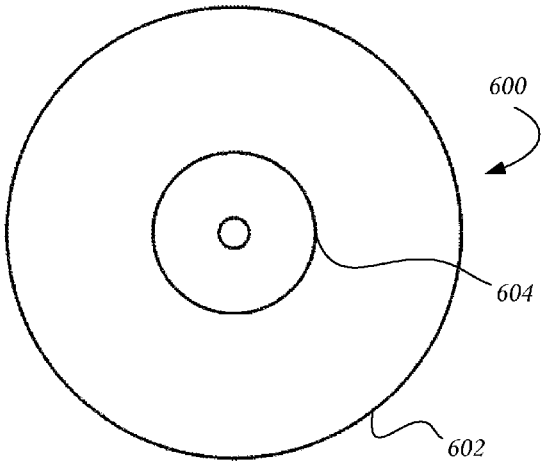
Figure 6D:
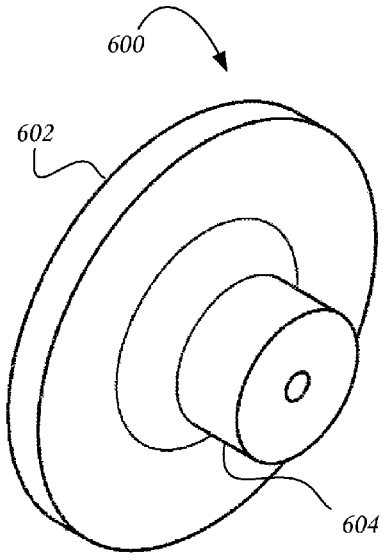
Figure 7:
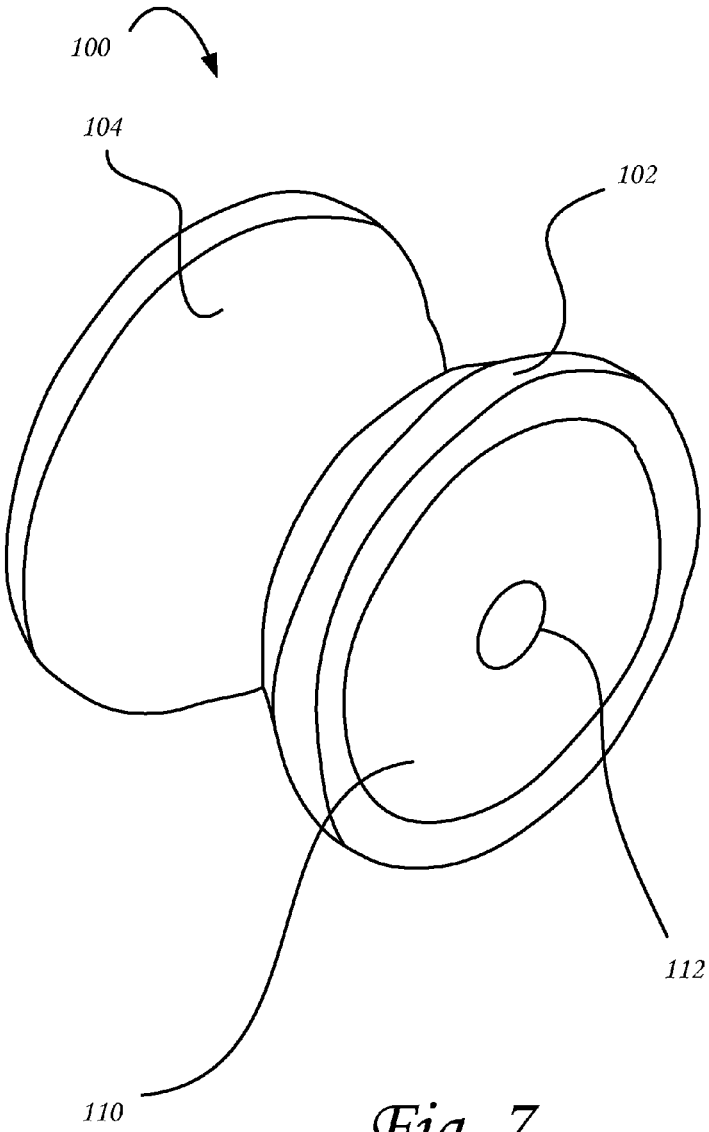
FIG. 7 is a perspective view of the yoyo of the present invention.

FIGS. 6*a*-6*c* are detailed drawings illustrating different views of a sidecap, according to some embodiments of the present invention. FIG. 6*a* is a side view of a sidecap 600. FIG. 6*b* is a front-on view of the sidecap 600 from the outer side of the yoyo. FIG. 6*c* is a front-on view of the sidecap 600 from an inner side of the yoyo. The sidecap 600 may be substituted to the first sidecap 412 and the second sidecap 414 of the yoyo 400 of FIG. 4.

The sidecap 600 is defined by an outer portion 602, facing the outside of the yoyo, and an inner portion 604, facing the center of mass of the yoyo. Optionally, the outer section 602 is shaped like a disc, and the inner section 604 is cylindrical.

The sidecap 600 sports an orifice centered about the main axis of the yoyo. The orifice is defined by an outer section 606, near the outer edge of the sidecap 600, and an inner section 608, near the inner edge of the sidecap 600. The outer section 606 of the orifice is designed for receiving and holding an attachment, such as the magnets 416 and 418 of FIG. 4. Optionally, the inner section 606 of the orifice is enclosed by a cylindrical wall having a diameter 606*a*. The inner section 608 of the orifice is designed for receiving and holding and end of the rod 410 of FIG. 4. Optionally, the inner section 606 of the orifice is enclosed by a cylindrical wall having a diameter 606*a*. In a variant, the wall of the inner section 608 of the orifice is threaded and designed for being connected to a threaded end of the rod 410.

Referring now to FIGS. 4, 5*a*-5*b*, 6*a*-6*c*, in an exemplary embodiment of the present invention, the yoyo 400 is characterized by the following elements.

A central bearing 406 having a length along the yoyo's main axis of about ¼ of an inch, a diameter of the inner race measuring about 5/16 of an inch, and a diameter of the outer race measuring about ½ of an inch.

Two yoyo halves (402 and 404) modeled after the yoyo half 500, having a diameter 500*a* of about 56 millimeters, a depth 500*b* of about 17 millimeters, an orifice 502, having a wall of diameter 502*a* measuring about ¼ if an inch, and a diameter 504*a* of the outer race of the protrusion 504 measuring about 5/16 of an inch.

Two sidecaps (412 and 414) modeled after the sidecap 600, having a diameter 606*a* of the outer section 606 of the orifice measuring about 10 millimeters, and a diameter 608*a* of the inner section 608 of the orifice measuring about ⅛ of an inch.

Two cylindrical magnets 416 and 418 having diameters of about ⅜ of an inch and thicknesses of about ⅛ of an inch.

A bushing 408 having a length of about 18 millimeters along the main axis of the yoyo, a diameter of the inner race measuring about ⅛ of an inch, and a diameter of the outer race measuring about ¼ of an inch.

A cylindrical rod 410 having a length of about 32 millimeters along the main axis of the yoyo, and diameter measuring about ⅛ of an inch.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A yoyo, comprising:

a first yoyo side, comprising:
- a first yoyo half; and
- a first sidecap, coupled to the first yoyo half;

a second yoyo side, comprising:
- a second you half;
- a second sidecap, coupled to the second yoyo half;

a central bearing disposed between the first and second yoyo halves configured for being attached to a string, the central bearing having an inner race connected to the first and the second yoyo sides and an outer race which rotates independently of the inner race;

a first side bearing, having an inner race connected to the first yoyo half and an outer race connected to the first sidecap;

a second side bearing, having an inner race connected to the second yoyo half and an outer race connected to the second sidecap;

a long bolt, comprising a long cylindrical threaded shaft, and a bolt head of the long bolt;

wherein the long bolt is configured for traversing an orifice of the first side bearing, and traversing an orifice of the central bearing, so that the bolt head of the long bolt pushes the first side bearing against a surface of the first yoyo half and the long bolt shaft is configured for being screwed into a threaded orifice of the second yoyo half thereby connecting the first yoyo half to the second yoyo half;

a short bolt, comprising a short cylindrical threaded shaft, and a bolt head of the short bolt, the short bolt configured for traversing an orifice of the second side bearing, so that the bolt head of the short bolt pushes the second side bearing against a surface of the second yoyo half;

wherein the short shaft is configured for being screwed into a threaded orifice of the second yoyo half;

wherein the second side cap is attached to the second side bearing thereby connecting the second side cap to the second yoyo half;

wherein the first side cap is attached to the first side bearing thereby connecting the first side cap to the first yoyo half;

wherein the first and second yoyo halves are configured rotate together in sync, and the first and second sidecaps are configured to rotate about the yoyo's main axis independently of the first yoyo half.

2. The yoyo of claim 1, wherein the first sidecap is configured for being connected to an attachment, so that the attachment rotates about the yoyo's main axis with the sidecap, independently of the first yoyo half.

3. The yoyo of claim 2, wherein the attachment is removable.

4. The yoyo of claim 2, wherein the attachment is a magnet.

5. The yoyo of claim 4, wherein the magnet is configured for joining the yoyo to a metallic surface, while the first yoyo half rotates.

6. The yoyo of claim 1, wherein the first sidecap and the second sidecap rotate about the yoyo's main axis independently of each other.

7. The yoyo of claim 1, wherein the first sidecap and the second sidecap rotate together about the yoyo's main axis.

* * * * *